United States Patent [19]

Sausner

[11] Patent Number: 4,668,440

[45] Date of Patent: May 26, 1987

[54] DEVICE FOR REGULATING ENGINE IDLING SPEED

[75] Inventor: Andreas Sausner, Frankfurt am Main, Fed. Rep. of Germany

[73] Assignee: VDO Adolf Schindling AG, Frankfurt am Main, Fed. Rep. of Germany

[21] Appl. No.: 879,657

[22] Filed: Jun. 27, 1986

[30] Foreign Application Priority Data

Jul. 12, 1985 [DE] Fed. Rep. of Germany ..... 3524911

[51] Int. Cl.[4] ..... F02M 3/07

[52] U.S. Cl. ..... 261/65; 123/337; 123/339

[58] Field of Search ..... 261/65; 123/337, 339

[56] References Cited

U.S. PATENT DOCUMENTS

| | | | |
|---|---|---|---|
| 4,408,581 | 10/1983 | Pfalzgraf et al. | 123/339 |
| 4,455,978 | 6/1984 | Atago et al. | 123/339 |
| 4,539,955 | 9/1985 | Wilson et al. | 123/339 |
| 4,541,378 | 9/1985 | Kitamura | 123/339 |
| 4,569,321 | 2/1986 | Bonfiglioli et al. | 123/339 |
| 4,590,906 | 5/1986 | Vriuhara et al. | 123/339 |

FOREIGN PATENT DOCUMENTS

| | | | |
|---|---|---|---|
| 0050707 | 2/1981 | European Pat. Off. . | |
| 56-96125 | 4/1981 | Japan | 123/339 |

*Primary Examiner*—Tim Miles
*Attorney, Agent, or Firm*—Martin A. Farber

[57] ABSTRACT

The device is provided in an intake pipe 9 in connection with a throttle valve 2 which is displaceable by a gas pedal 7 and acted against by a return spring 8. To this throttle valve there is connected a rotary element 9 on which there is developed at least one rotary stop 10 which limits an angular range of the idling aspiration regulation. The rotary element is coupled to an actuator 16. The throttle valve 2 serves as closure member which determines the idling air throughput. A swingably mounted regulating lever 5 is connected to the gas pedal 7 and the return spring 8, by which the lever can be moved back against a fixed regulating lever stop 12. The rotary element 9 to which the throttle valve is fastened is carried along by the regulating lever 5 as a result of actuation of the gas pedal only when the regulating lever rests against the rotary stop 10 of the rotary element 9. On the other hand, the rotary element 9 is decoupled from the return spring 8 when the rotary stop 10 is moved away from the regulating lever 5 by the actuator 16 which acts on the rotary element 9. In this way, a sensitive idling admission regulation can be obtained with little structural expense or expense for energy although the return spring of the entire device is made strong for reasons of safety.

8 Claims, 3 Drawing Figures

DEVICE FOR REGULATING ENGINE IDLING SPEED

FIELD AND BACKGROUND OF THE INVENTION

The present invention relates to a device for regulating the idling speed of rotation of an Otto engine, particularly in an automotive vehicle in general.

In particular the invention relates to a device for regulating the idling speed of rotation of an Otto engine, particularly in an automotive vehicle, which has, within an intake pipe, a throttle valve which is under the action of at least one return spring and can be displaced by a gas pedal, having a rotary element attached firmly to the throttle valve and on which at least one rotary stop limiting an angular range of the idling admission regulation is formed and which can be coupled with the actuator which is provided for actuating a closure member which determines the idling air throughput.

In one such known device for regulating the idling speed of rotation, the devide is combined with a device for controlling the speed of travel of the automotive vehicle in such a manner that a single common actuator for control of the speed of the vehicle and regulation of the idling speed of rotation is sufficient (European Patent Application Publication No. 0 050 707). Within a first operating range, a closure element for regulating the idling speed of rotation can be actuated by the actuator; and, within a second operating range, a setting element for the control of the speed of the vehicle can be actuated by the actuator. The closure element for regulating the idling speed of rotation can be actuated by the actuator and, in its turn, the setting element for the control of the speed of the vehicle can be actuated by the closure element. If the closure element for the regulating of the speed of rotation is brought into operational connection with the setting element of the vehicle speed control only in the open end position of said closure element, this makes it possible that, in the idle position of a set-point setting means or of a gas pedal, only the closure element for the regulating of the idling speed of rotation is actuated. On the other hand, if the set-point setting means is moved out of its position of rest then the actuator, via the closure element for the regulating of the idling speed of rotation, displaces the setting element for the control of the speed of the vehicle. The setting element for the control of the speed of the vehicle is normally a throttle valve which is located in fixed position on a hollow shaft and is urged by a spring into an end position; the end position limits the rotary movement and corresponds to the closed position of the throttle valve. Within the hollow shaft there is mounted an actuation shaft on which the actuator acts. Between the actuation shaft and the hollow shaft there is positioned a clutch by which the rotary movement of the actuation shaft is transmitted to the hollow shaft after a rotation of the actuation shaft out of a position, corresponding to the closed position of the closing element for regulating idling speed, into a position corresponding to the opened position of the closure element. For this purpose, a radially directed stop which engages into a groove in the hollow shaft and/or the actuation shaft can be provided as coupling on the actuation shaft and/or on the hollow shaft. As closure element for the regulating of the idling speed of rotation, an idling valve is connected to the actuation shaft. A coaxial opening in the throttle valve can be opened to a greater or lesser extent by means of the idling valve. Air can accordingly flow from the region of the intake pipe in front of the throttle valve into the region behind the throttle valve and adjust the idling speed of rotation. The device of the foregoing patent therefore provides for a change in the characteristic between the operating range of the closing element for the regulating of the idling speed of rotation and the operating range of the setting element for the regulating of the speed of the vehicle, both of which are displaced by the same actuator. The actuator is therefore to be designed with sufficient capacity to displace the throttle valve against the return spring as setting element for the control of the vehicle speed.

For the same reason, the control electronics must make available a suitable amount of energy for operating the actuator. Since the same actuator is to regulate the idling speed and effect control of the speed of the vehicle, coordinated control and regulating circuits must be provided, these necessitating corresponding expense of manufacture and adjustment. Such vehicle speed control furthermore normally presupposes an electric set-point setting means for the gas-pedal position. Aside from this, the expense for the manufacture of the throttle valve, which is intended to close the intake pipe at one end position, and for the idle valve which is intended to open or close the coaxial opening in the throttle valve to a greater or lesser extent, is high, particularly because of the sealing problems inherent therein.

SUMMARY OF THE INVENTION

The object of the present invention is to reduce the cost of manufacture of the closure element and/or the idle valve for regulating the idling speed of rotation with reference to the sealing problems inherent in such valves. The device of the invention permits a sensitive, reliable adjustment of the idling speed of rotation with an actuator of small power. The throttle valve, which determines the air throughput corresponding to the gas-pedal position in the partial and full load regions of the Otto engine, is to be capable of being displaced also mechanically by the gas pedal, i.e. without electrical transmission elements. In this way, the device is to be suitable for use for idling speed of rotation controls for a large variety of different automotive vehicles.

According to the present invention the throttle valve (2) is provided as closure element which determines the idling air throughput that a swingably mounted regulating lever (5) is connected to the gas pedal (7) and can be reset by a return spring (8) against a fixed regulating lever stop (12) and is so arranged with respect to a rotary element (9) that the rotary element is carried along against the force of the return spring by the regulating lever (5), which has been swung away from the regulating lever (5), which has been swung away from the regulating lever stop, when the regulating lever strikes against the rotary stop (10), and that the rotary element (9) is decoupled from the return spring (8) when the rotary stop (10) is turned away from the regulating lever (5) by the actuator (16) which acts on the rotary element (9).

In accordance with the principle of the invention, only a single closing member is required for regulating the idling speed of rotation and the idling air throughput as well as for adjusting the air throughput depending on the position of the gas pedal. A single throttle valve in the intake pipe is used for both functions. In this way, it is possible to avoid in particular the sealing problems of a second closure member. The cost of manufacture is reduced accordingly. The regulating rod, the return spring and other parts which determine the position of the throttle valve as a function of the position of the gas pedal can be made sturdy and so as to operate in dependable manner with large mass without disturbing the regulation of the idling speed of rotation. The actuator which is provided exclusively for the adjustment of the throttle valve for the regulating of the idling speed of rotation, i.e. for the regulating of the idling aspiration of the engine, can be dimensioned for a small power output since it need not effect the displacement of the throttle valve corresponding to actuation of the gas pedal and in opposition to the force of the return spring. Since the electric control and regulating signals which determine the feeding of the actuator are formed independently of the position of the gas pedal, the control and regulating electronics can be developed in uncomplicated fashion.

The device is advantageously further developed such that the actuator (16) displaces a movable stop (14) against which the rotary element (9) can come to rest in radial direction and that between the rotary element (9) and the regulating rod (5) a coupling spring (compression spring 15) is so arranged that the rotary element loads in the direction towards the idling stop (14) as well as with the rotary stop (10) in the direction towards the regulating lever (5), and that the coupling spring (compression spring 15) exerts a weaker moment that the return spring (8) on the rotary element (5).

The displacement of the throttle valve within the idling aspiration region is effected by the actuator in opposition to the moment adjusting the throttle valve, which moment is formed by the coupling spring to the regulating rod. This adjustment moment is substantially less than the adjustment moment which is produced by the return spring of the device upon actuation of the gas pedal outside the idling aspiration regulating range since this moment of the return spring does not act as long as the regulating lever lies against the rotary stop. The regulating lever strikes against a regulating lever stop when the gas pedal is suddenly released and a large momentum is produced which need not be taken up by the actuator and the parts cooperating with it, in particular a rotary element. Furthermore it is advantageous, from a standpoint of regulating technique, that a throttle-valve switch which is in communication with the gas pedal give off a signal upon actuation of the gas pedal, even before the throttle valve is moved out of its idle position determined by the actuator, until the regulating lever comes against the rotary stop of the rotary element and the throttle valve is carried along by the rotary element.

The structural expense can be further reduced and the compactness of the device improved if the rotary element (9) and the regulating lever (5) are mounted coaxially.

It is particularly advantageous for the actuator which determines the position of the rotating element in the idling aspiration regulating range to be self-locking. In such case, electrical energy need be fed into the actuator only when a change in the idling aspiration is to take place. In the other, by far predominant period of time, on the other hand, the actuator requires no energy.

A particularly advantageous actuator which has a self-locking action and displaces a shaft which acts as movable idle stop is formed by a modification of a stepping motor. This modification provides that the actuator (16) is developed as an electric stepping motor which is controllable stepwise and has a stator (17), a rotor (18) and a shaft (27) which is mounted nonrotataby but translatably concentric to the rotor, said shaft being connected via thread (23) to the inside (part 22) of the rotor.

BRIEF DESCRIPTION OF THE DRAWINGS

With the above and other objects and advantages in view, the present invention will become more clearly understood in connection with the detailed description of the preferred embodiments, when considered with the accompanying drawings, of which.

DETAILED DESCRIPTION OF THE PREFERRED EMBODIMENTS

Figure 1:
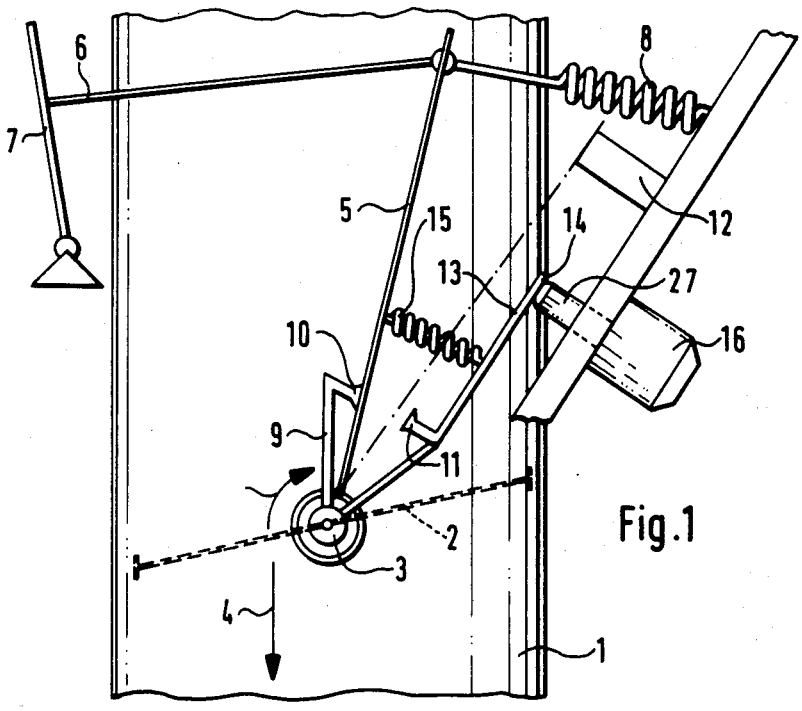
FIG. 1 is a diagrammatic showing of a device for regulating the idling speed of rotation in combination with the displacement of a throttle valve by a gas pedal.

In FIG. 1, an intake pipe 1 of an Otto engine has a throttle valve 2 which is fastened to a throttle valve shaft 3 and can be turned with the latter to determine the air throughput through the intake pipe from an upper region, on the carburetor side, to a lower region, on the intake side of the Otto engine. The air throughput therefore flows in the direction indicated by an arrow 4.

Since the throttle valve 2 regulates both the air flow upon normal operation of the Otto engine in the partial and full load ranges as well as in the idling range, a bypass as well as a separate closure element in the bypass are dispensed with, in advantageous fashion.

Concentric to the throttle valve 3 shaft there is swingably mounted a regulating lever 5 to which a gas pedal 7 as well as a strong return spring 8 which acts here as tension spring are linked via a regulating rod 6.

The regulating lever 5 cannot act in customary manner directly on the throttle valve 2 but only via a rotary element 9 which is connected to the throttle valve shaft 3. The rotary element 9 has two radially acting rotary stops 10 and 11 the angular distance between which, measured from the common axis of rotation of the throttle valve and of the regulating lever, determines the maximum angular range of the idling admission regulation.

This angular range for the idling admission control, which amounts, in particular, to about 10°, can be traversed over for the adjustment of the idling admission by displacement of the rotary element 9, in particular when the regulating lever 5 rests against a fixed regulating lever stop 12; see the dot-dash line in FIG. 1.

The displacement of the rotary element 9 within the angular range of the idling admission regulation is effected via an arm 13 of the rotary element against which a movable idle stop 14 can strike.

By means of a compression spring 15 which exerts substantially less force than the return spring 8 on the regulating lever 5, the arm 13 is pressed by the regulating lever 5 in the direction towards the movable idle stop. In this connection, the regulating lever 5 can rest against the rotary stop 10 in the position of the rotary element 9 shown and with the rotary element displaced further in counterclockwise direction.

If, on the other hand, the regulating lever 5 is located in the dot-dash position of rest with the gas pedal released and the regulating lever 5 is held fast in this position by the return spring 8, the rotary element 9 can be so displaced by the movable idle stop 14 via the arm 13 that the rotary stop 10 moves away from the regulating lever 5 until the entire idling admission regulating range has been traversed and the rotary stop 11 comes against the regulating lever.

The movable idle regulating stop 14 is formed by the front end of a displaceable shaft 27 which is a part of a self-locking actuator 16.

Figure 2:
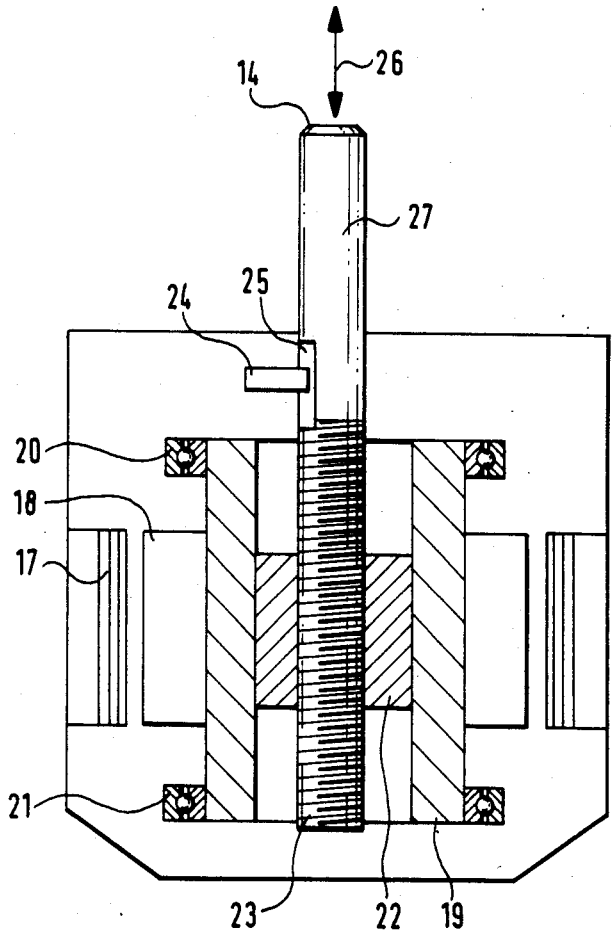
FIG. 2 is a longitudinal section through a detail in FIG. 1, namely through an actuator.

Details of the actuator 16 can be noted from FIG. 2: In this figure, an electric stepping motor having a stator 17 and a rotor 18 is shown in simplified form. The rotor is mounted with bearings 20, 21 for rotation, but not translation, on a hollow shaft 19. A part 22 which is firmly attached to the hollow shaft is provided with an internal thread which cooperates with the thread 23 on the shaft 27. By means of a slide pin 24 which is fixed in space and engages into a longitudinal groove 25 in the shaft 27 the shaft is held non-rotatably but translatable in the direction of a part 26.

The arrangement of the shaft 27 in the actuator 16 is self locking so that the actuator must be acted on by electrical pulses only for changing the axial position of the shaft 27. The electrical pulses thus determine the degree of the idling admission regulation. Since the actuator 16 need merely overcome the force of the compression spring 15, but not the force of the return spring 8 for the displacement of the throttle valve 2, pulses of relatively low power and an inexpensive, small actuator are sufficient.

The device described is shown in a position in which the throttle valve 2 is displaced by the gas pedal 7, the flow of force extending from the gas pedal 7, via the regulating rod 6 against the force of the return spring 8, the regulating lever 5, the rotary stop 10 and the rotary element 9, to the throttle valve 2. In this connection, form-lock prevails between the regulating lever 5 and the rotary element 9 at the rotary stop 10. The adjustment of the aspiration of the Otto engine is effected in this manner as long as neither the regulating lever strikes against the fixed regulating lever stop 12 nor the arm 13, as setting element, rests against the movable idle stop 14. As soon a the movable idle stop 14 comes to rest against the arm 13—this limit situation is shown in FIG. 1—the transfer to the idling admission regulation takes place. In this case the rotary element 9 is held fast via the arm 13 so that it cannot be moved further in clockwise direction into the closed position of the throttle valve 2. By axial displacement of the movable idle stop 14, the rotary element 9 and with it the throttle valve 2 can be displaced, it being merely necessary to overcome the force of the compression spring 15, i.e. of the coupling spring between the regulating lever 5 and the arm 13. This relatively small moment which adjusts the throttle valve 2 comes from the left-hand part of the branch of the curve of FIG. 3, within the region IAR [idling aspiration regulation], since the curve is of small slope there.

Upon the release of the gas pedal, the regulating lever 5 can be pulled back against the fixed stop 12 by the return spring 8 without the position of the throttle valve 2 being changed thereby. When the regulating lever 5 strikes against the fixed regulating-lever stop 12 as a result of the strong return spring 8, the resultant forces and momentum are not conducted further to the rotary element 9 or the actuator 16, but rather the coupling to these parts is interrupted in the manner that the coupling spring 15 is compressec by the stronger return spring 8 and the regulating lever 5 is moved away from the rotary stop 10.

Figure 3:
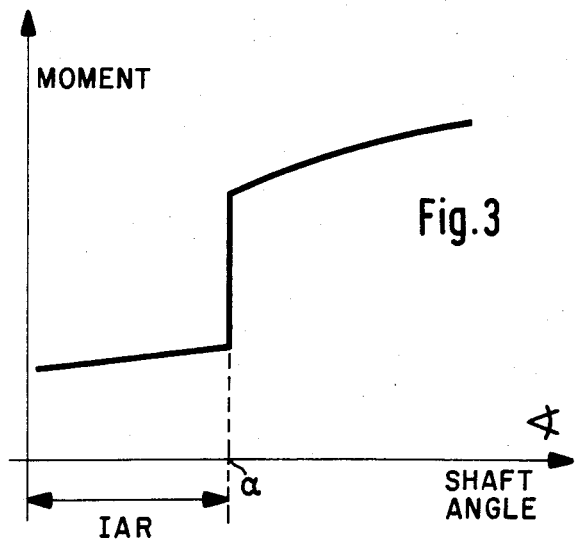
FIG. 3 is a diagram which shows the change of the moment of rotation $MD_{zu}$ which adjusts the throttle valve as a function of the angular position of the throttle valve.

When the driver displaces the gas pedal 7 from the position of rest in which the regulating lever 5 lies against the fixed regulating lever stop 12, i.e. when he gives gas, the rotary element 9 is carried along by the regulating lever 5 only when the regulating lever 5 comes to rest against the rotary stop 10. This situation is shown in FIG. 3 at the place $\alpha$ which corresponds to the configuration in FIG. 1. From this place on, the large moment of the return spring 8 acts as adjusting rotary moment of the throttle valve 2, as is indicated by a discontinuity in FIG. 3. Upon further pressure on the gas pedal 7, the throttle valve 2 is to be displaced against the moment of the return spring 8. This can be noted from the relatively steep slope of the right-hand part of the curve in FIG. 3.

From the above description, read in conjunction with FIG. 1, it is clear that the driver can move the regulating rod 6 away from the fixed regulating lever stop 12 by actuating the gas pedal 7 by a certain amount until a corresponding movement of the throttle valve 2 takes place. Therefore, a switch for the giving off of an early control signal can be controlled by the regulating lever 5 before the throttle valve 2 leaves its position of rest.

Upon the return of the throttle valve 2 by release of the gas pedal 7, good reliability of operation prevails since the return spring 8 can be developed as a strong spring without encumbering the idling aspiration regulation mechanism. The resetting is effected furthermore in reliable manner since the regulating lever 5 can move only within the dead space in the rotary element 9 which is limited by the rotary stops 10, 11.

I claim:

1. A device for regulating the idling speed of rotation of an Otto engine, particularly an Otto engine in an automotive vehicle, which engine comprises:

an intake pipe, and a throttle valve within the intake pipe;

a return spring and a gas pedal, said throttle valve being under the action of at least one said return spring and displaceable by said gas pedal;

a rotary element and an actuator and a closure element, said rotary element being attached firmly to the throttle valve and having at least one rotary stop limiting an angular range of idling engine aspiration regulation, said rotary stop being coupled with the actuator, said actuator actuating said closure member to establish an idling air throughput; the improvement wherein said throttle valve serves as said closure element to establish the idling air throughput, said device further comprising:

a fixed regulating lever stop, and a swingably mounted regulating lever connected to the gas pedal, said lever being resettable by a return spring against said fixed lever stop, said lever being so arranged with respect to said rotary element that the rotary element is carried along against the force of the return spring by the regulating lever during a swinging of said lever away from the regulating lever stop and during a contacting of the regulating lever against the rotary stop; and wherein the rotary element is decoupled from the return spring when the rotary stop is turned away from the regulating lever by the actuator, which actuator acts on the rotary element.

2. The device according to claim 1, further comprising a movable idle stop and a coupling spring; and wherein the actuator displaces said movable idle stop against which the rotary element can come to rest; and wherein between the rotary element and the regulating lever said coupling spring is connected to enable the rotary element to act in a direction towards the idle stop, and to act with the rotary stop in a direction towards the regulating lever, the couping spring exerting a weaker moment that the return spring on the rotary element.

3. The device according to claim 1, wherein the rotary element and the regulating lever are mounted coaxially.

4. The device according to claim 1, wherein the actuator is self locking.

5. The device according to claim 4, wherein said actuator comprises as an electric stepping motor which is controllable stepwise and has a stator, a rotor and a shaft which is mounted non-rotatably but translatably and concentric to the rotor, said shaft being connected via a thread to the inside of the rotor.

6. The device according to claim 2, wherein the rotary element and the regulating lever are mounted coaxially.

7. The device according to claim 2, wherein the actuator is self locking.

8. The device according to claim 7, wherein said actuator comprises as an electric stepping motor which is controllable stepwise and has a stator, a rotor and a shaft which is mounted non-rotatably but translatably and concentric to the rotor, said shaft being connected via a thread to the inside of the rotor.

* * * * *